United States Patent [19]

Asphahani

[11] 4,168,188

[45] Sep. 18, 1979

[54] ALLOYS RESISTANT TO LOCALIZED CORROSION, HYDROGEN SULFIDE STRESS CRACKING AND STRESS CORROSION CRACKING

[75] Inventor: Aziz I. Asphahani, Kokomo, Ind.

[73] Assignee: Cabot Corporation, Kokomo, Ind.

[21] Appl. No.: 876,531

[22] Filed: Feb. 9, 1978

[51] Int. Cl.[2] ..... C22C 19/05

[52] U.S. Cl. ..... 148/32; 75/171; 148/11.5 N; 148/12.7 N; 148/32.5

[58] Field of Search ..... 75/171, 170; 148/32, 148/32.5, 11.5 N, 12.7 N

[56] References Cited

U.S. PATENT DOCUMENTS

| | | | |
|---|---|---|---|
| 1,710,445 | 4/1929 | Becket | 75/170 |
| 1,836,317 | 12/1931 | Franks | 75/171 |
| 2,109,285 | 2/1938 | Brown | 75/171 |
| 3,203,792 | 8/1965 | Scheil et al. | 75/171 |

*Primary Examiner*—R. Dean

*Attorney, Agent, or Firm*—Jack Schuman; Joseph J. Phillips

[57] ABSTRACT

An alloy and a metal product characterized by resistance to localized corrosion, hydrogen sulfide stress cracking (hydrogen embrittlement) and stress corrosion cracking at temperatures up to about 200° C. consisting essentially of nickel 40–65%, cobalt 0–5%, chromium 10–20%, molybdenum 12–18%, iron 10–20%, tungsten up to 5%, carbon 0–0.1% manganese up to 3%, vanadium up to 1% and silicon up to 0.2%. The alloy resistance is maintained when it is cold worked over 20%.

6 Claims, No Drawings

ALLOYS RESISTANT TO LOCALIZED CORROSION, HYDROGEN SULFIDE STRESS CRACKING AND STRESS CORROSION CRACKING

This invention relates to high strength corrosion resistant alloys which are resistant to hydrogen sulfide stress cracking (hydrogen embrittlement) and to stress corrosion cracking and particularly to alloys which are useful for manufacturing high strength pipe and tubing resistant to corrosion and hydrogen cracking.

There are many situations where it is necessary to have an alloy which will resist hydrogen sulfide stress cracking and stress corrosion cracking in a corrosive atmosphere particularly at temperatures above those of ordinary atmospheric temperatures. One of the situations in which this occurs is in the handling of that form of natural gas which is generally called "sour gas". Sour gas is a natural gas product usually found at great depths and highly contaminated with hydrogen sulfide and carbon dioxide along with brines containing high chloride concentrations. Due to the great depths at which they are found, the temperature at the well bottom may be in the neighborhood of 200° C. and more. It is a well known fact that ordinary well pipe and tubing will be destroyed in a matter of hours in many cases in the hostile environment of the sour gas well. It is also well known that sour gas is, itself, extremely toxic and failures in handling equipment can be fatal. This is typical of the kind of application for which an alloy resistant to localized corrosion, hydrogen sulfide and a stress corrosion cracking would be desirable.

I have discovered a new corrosion resistant alloy which also will resist hydrogen sulfide stress cracking and stress corrosion cracking to a degree far above that of any alloy now known to me, and I believe better than any alloy known in the art. The alloy of this invention, having the broad composition 40–65% nickel, 0–5% cobalt, 10–20% chromium, 12–18% molybdenum, 10–20% iron, 0–5% tungsten, up to 0.1% carbon, up to 3% manganese, vanadium up to 1% and up to 0.2% silicon, will be resistant to hydrogen sulfide stress cracking and stress corrosion cracking under the conditions discussed above. For optimum results, a maximum of 0.02% carbon is suggested. All compositions are given in percent by weight. A preferred composition according to this invention has the following specific composition:

Cobalt: 1%
Chromium: 15%
Molybdenum: 15%
Iron: 15%
Tungsten: 4%
Carbon: 0.006%
Silicon: 0.03%
Manganese: 1%
Vanadium: 0.2%
Nickel: Balance This alloy must be then cold worked at least 20% in order to obtain the optimum yield and ultimate tensile strengths.

The ability of a material to withstand hydrogen sulfide stress cracking is usually measured by inserting the material into a standard NACE solution (National Association of Corrosion Engineers Solution) at room temperature.

The NACE solution is composed of oxygen-free water containing 5% sodium chloride, 0.5% acetic acid and is saturated with hydrogen sulfide thus simulating the sour gas well environment. The stressed and immersed material is checked periodically for cracking.

As elevated temperatures are encountered in deep sour gas wells, the material should also be resistant to stress corrosion cracking when tested in the NACE solution at temperatures close to 200° C.

Ordinary carbon steel articles such as tubing and articles made of all of the alloys presently known with their existing treatments fail the room temperatures and/or the elevated temperature tests in a matter of hours to a few days at high strength levels. However, the alloy of this invention when subject to both tests shows markedly increased resistance to hydrogen sulfide stress cracking and to stress corrosion cracking without any detriment to its ability to withstand localized corrosion.

The marked ability of the material of this invention to resist hydrogen sulfide stress cracking, stress corrosion cracking and localized corrosion will be apparent from the following example illustrating the alloy of this invention compared with other presently available corrosion resistant alloys.

EXAMPLE I

Five different alloy compositions were melted and tested for hydrogen sulfide stress cracking (caused by cathodic hydrogen resulting from galvanic coupling to carbon steel), stress corrosion cracking and localized corrosion. Each of these materials was cold worked 60% and aged for 200 hours at 200° C. to simulate operations under deep sour gas well environment. The results of these tests appear in Table I showing the resistance to hydrogen sulfide stress cracking in NACE solution at room temperature and at 200° C. Also they show the resistance to stress corrosion cracking and to localized corrosion.

The analysis of each of the materials which appears in Table I is set out in Table II. From the foregoing example, it is apparent that the typical alloy compositions of this invention (Alloys 2 and 3) are effective in resisting hydrogen sulfide stress cracking and in resisting, at the same time, stress corrosion cracking and localized corrosion.

TABLE I

Test Results of Alloys Described in Example I

| Alloy No. | $H_2S$ Stress Cracking (>1000 hrs.) NACE Solution R.T., (C-Steel bolt) 60% C.W. + 200 hrs/200° C. | Stress Corrosion Cracking (>500 hrs.) 60% C.W. + 200 hrs/200° C. NACE Solution/200° C. | NACE 25% NaCl/200° C. | Boiling 45% $MgCl_2$ | Localized Corrosion (24 hrs) Boiling Acidic Oxidizing Chlorides Solution Annealed |
|---|---|---|---|---|---|
| 1 (5%Fe) | Cracking | No Cracking | Cracking | No Cracking | No attack* |
| 2 (10%Fe) | No Cracking | No Cracking | — | No Cracking | No attack |
| 3 (15%Fe) | No Cracking | No Cracking | No Cracking | No Cracking | No attack* |

TABLE I-continued

| Alloy No. | $H_2S$ Stress Cracking (>1000 hrs.) NACE Solution R.T., (C-Steel bolt) 60% C.W. + 200 hrs/200° C. | Stress Corrosion Cracking (>500 hrs.) 60% C.W. + 200 hrs/200° C. NACE Solution/200° C. | NACE 25% NaCl/200° C. | Boiling 45% $MgCl_2$ | Localized Corrosion (24 hrs) Boiling Acidic Oxidizing Chlorides Solution Annealed |
|---|---|---|---|---|---|
| 4 (20%Fe) | No Cracking | No Cracking | — | Cracking | Attack (Pitting) |
| 5 (20%Fe) | No Cracking | Cracking | Cracking | Cracking | Attack (Pitting) |

*Same performance when cold worked

TABLE II

| Alloy No. | Ni | Co | Cr | Mo | W | Fe | Si | Mn | C | V | Cu |
|---|---|---|---|---|---|---|---|---|---|---|---|
| | Composition (weight percent) | | | | | | | | | | |
| 1 | 55 | 2.5* | 16 | 16 | 4 | 5 | .08* | 1* | .02* | .35* | — |
| 2 | 52 | 1.8 | 15.2 | 16 | 3.3 | 10 | .05 | .08 | .004 | .21 | — |
| 3 | 49 | .65 | 15.4 | 15.9 | 3.5 | 15.1 | .03 | .35 | .006 | .21 | — |
| 4 | 43 | 1.7 | 15.3 | 15.8 | 3.3 | 20.4 | .05 | .26 | .005 | .19 | — |
| 5 | 42 | 2.5* | 22 | 6.5 | 1* | 19.5 | 1* | 1.5 | .05* | — | 2 |

*Maximum

In the foregoing specification, I have set out certain preferred practices and embodiments of my invention, however, it will be understood that this invention may be otherwise embodied within the scope of the following claims.

I claim:

1. An alloy resistant to localized corrosion, to hydrogen sulfide stress cracking and to stress corrosion cracking at temperatures up to 200° C. consisting essentially of nickel 40–65%, cobalt 0–5%, chromium 10–20%, molybdenum 12–18%, iron 10–20%, tungsten up to 5%, carbon 0–0.1%, manganese up to 3%, vanadium up to 1% and silicon up to 0.2%, said alloy having been subject to at least 20% cold working.

2. An alloy as claimed in claim 1 wherein the carbon content is 0–0.02%.

3. An alloy product as claimed in claim 1 which has been subjected to about 50% cold working.

4. An alloy as claimed in claim 1 having the composition cobalt 1%, chromium 15%, molybdenum 15%, iron 15%, tungsten 4%, carbon 0.006%, silicon 0.03%, manganese 1%, vanadium 0.2% and the balance nickel.

5. A tubular metal product for use in sour gas wells and characterized by resistance to localized corrosion, hydrogen sulfide stress cracking and stress corrosion cracking at temperatures up to about 200° C. consisting essentially of an alloy having the composition nickel 40–65%, cobalt 0–5%, chromium 10–20%, molybdenum 12–18%, iron 10–20%, tungsten up to 5%, carbon 0–0.1%, manganese up to 3%, vanadium up to 1% and silicon up to 0.2%, said product having been cold worked in excess of 20%.

6. A tubular metal product as claimed in claim 5 wherein the carbon content is 0 to 0.02%.

* * * * *